United States Patent [19]

Whitaker et al.

[11] Patent Number: 4,633,585

[45] Date of Patent: Jan. 6, 1987

[54] CONTINUOUS WATER-SUPPLIED SHAVING APPARATUS

[76] Inventors: James Whitaker, Rte. 1, Box 234; James Fultz, Rte. 4, Box 252A 9F7, both of Elkhorn, Wis. 53121

[21] Appl. No.: 702,081

[22] Filed: Feb. 15, 1985

[51] Int. Cl.[4] ..... B26B 21/44

[52] U.S. Cl. ..... 30/41; 30/123.3

[58] Field of Search ..... 30/41, 41.5, 41.6, 123.3

[56] References Cited

U.S. PATENT DOCUMENTS

| | | | |
|---|---|---|---|
| 2,336,806 | 12/1943 | Schenk | 30/41 |
| 2,686,361 | 8/1954 | Resnick et al. | 30/41 |
| 3,126,889 | 3/1964 | Blumenfeld | 30/123.3 |
| 3,364,068 | 1/1968 | Stern | 30/41 X |
| 4,177,556 | 12/1979 | Galli, Jr. | 30/41 |
| 4,205,441 | 6/1980 | Turner | 30/41.5 |
| 4,228,586 | 10/1980 | Thierry | 30/41 |
| 4,370,807 | 2/1983 | O'Neill | 30/41.5 |
| 4,484,417 | 11/1984 | Klingerman | 30/123.3 |

*Primary Examiner*—Jimmy C. Peters

*Attorney, Agent, or Firm*—Schwartz, Jeffery, Schwaab, Mack, Blumenthal & Evans

[57] ABSTRACT

Disclosed is a shaving apparatus which utilizes a continuous water supply, and comprises a shaver, a valve means connected to a water supply means, a flexible tubing connecting the valve means to the shaver and a swivel attachment of the tubing and the shaver handle. The shaver is provided with inner passageways and orifices in the shaver head for transporting and dispersing water from the shaver to the surface to be shaved and across the shaving edge.

16 Claims, 9 Drawing Figures

FIG. 2A
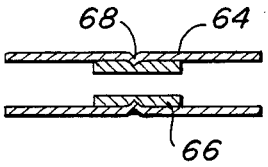
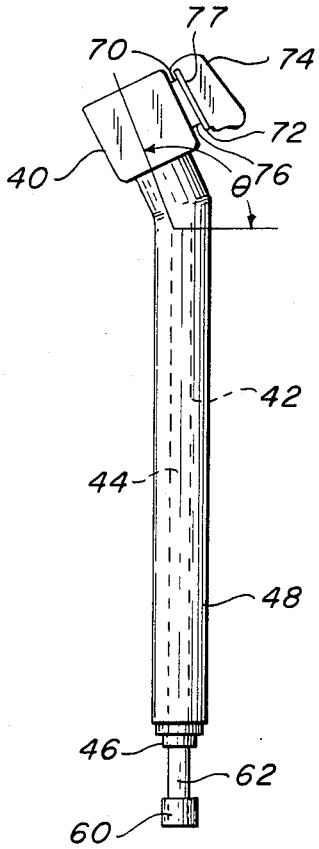
FIG. 3

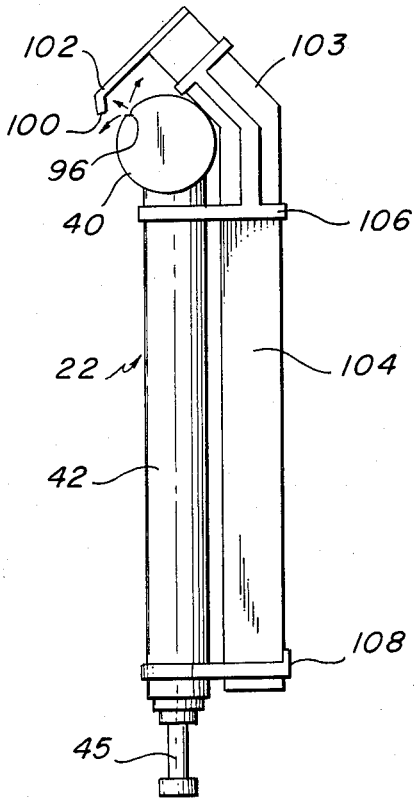
FIG. 5
FIG. 5A
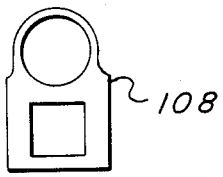

FIG. 6
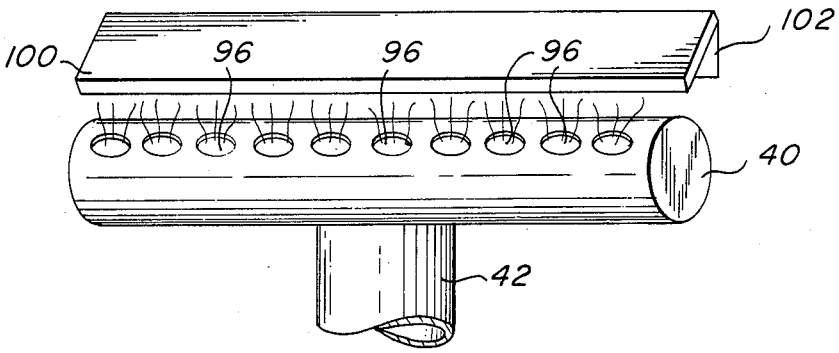
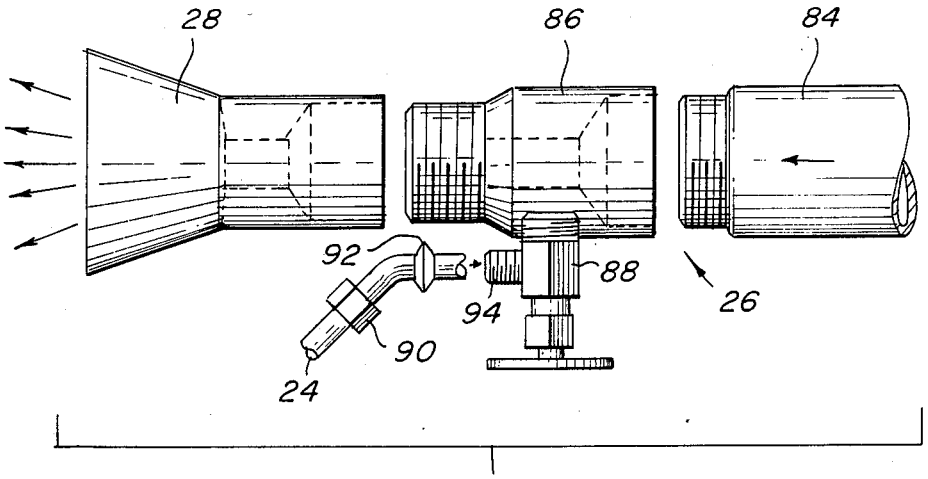
FIG. 7

CONTINUOUS WATER-SUPPLIED SHAVING APPARATUS

BACKGROUND OF THE INVENTION

The present invention relates to a novel shaving apparatus, and more particularly, to a shaving apparatus which incorporates a continuous water supply.

A variety of shaving devices are presently available for removing unwanted hair from the human body. This includes both removal of a man's facial hair and the removal of hair from a woman's body. The great majority of these devices involve a somewhat cumbersome process in which the body surface to be shaved is wetted with water, and thereafter, a lathering substance is applied to the wetted surface and conditioned to produce a lather. In this manner the surface to be shaved is moisturized to prevent unnecessary nicks and cuts and to improve the closeness of the shave. Only after this pretreatment does the actual shaving process begin. However, the process is further lengthened because the user must periodically cease shaving to wash from the shaver the lather and shaving stubble removed from the shaved body surface. Otherwise, the waste material collecting on the shaver would reduce shaving efficiency and prevent the user from attaining a close shave. There is really no substitute for a razor shave, but as nearly everyone knows, this procedure is quite time consuming.

A limited number of attempts have been made to streamline the cumbersome process. For example, U.S. Pat. No. 4,177,556 and No. 4,228,586 disclose shaving apparatuses which can be attached to a faucet via a tubing. Water is supplied from the faucet through the tubing and through the shaver itself. The object of these designs is to provide a means for cleaning the blades of the shaver. However, apparatuses of this type, are not convenient in everyday use. For example, the shavers cannot be easily positioned in the variety of positions necessary during shaving. This results from the fact that the shaver and the tubing are connected so that twisting or turning the shaver necessarily produces a twisting or turning of the tubing. In biasing the tubing in this manner, the danger of nicks and cuts is increased since the tubing is continuously attempting to release the torque. Furthermore, these prior art shaving apparatuses are subjected to the full effect of the water supply, and therefore, necessarily must be of a heavier, thicker and necessarily more cumbersome construction. This factor also leads to a decrease in the maneuverability of the shaver during use. Furthermore, the shaver described in U.S. Pat. No. 4,177,556 cannot be utilized in an inverted position for the water would not be dispersed over the cutting edge, and the waste matter would accumulate on the blades resulting in the same problems noted above in regard to the majority of the prior art devices. As a practical matter, it is not possible to house within the razor itself a valve mechanism which is sufficiently strong to withstand full water-line pressure.

Another shortcoming of these prior art devices is that a valve is provided in the handle portion of the shaver which operates basically as an on/off switch. When the valve is engaged, the inner water passageway is open providing for flow of water from the faucet to the shaver head. Such an arrangement, however, results in a buildup of pressure on the valve. Not only is the valve structure continually subjected to this back pressure, but also, such a structure results in only intermittent supply of water to the shaver head.

Accordingly, a need exists for a shaving apparatus which can provide continual cleansing action to the shaver blades, while not subjecting the shaving apparatus itself to the water pressure of the water supply means being utilized. Additionally, there exists a need for a shaver which in addition to the above characteristics, allows the user to comfortably and conveniently position the shaver in any position necessary to achieve a close shave without increasing the risk of cutting the skin surface being shaved.

SUMMARY OF THE INVENTION

It is therefore an object of the present invention to provide an improved shaving apparatus utilizing a continual water supply.

Another object of the present invention is to provide a shaving apparatus in which the shaving edge is continually rinsed by the water supply.

Yet another object of the present invention is to provide a shaving apparatus which utilizes the water supply to moisten the surface to be shaved prior to shaving, thus eliminating the need for lathering substances.

Additionally, an object of the present invention is to provide a shaving apparatus which is continually supplied with water without subjecting the shaver to the full effect of the water supply pressure.

Still another object of the present invention is to provide a shaving apparatus which can be used in any position, even inverted, during the shaving process without increasing the danger of nicks or cuts to the skin surface.

Still yet another object of the present invention is to provide a method for shaving using a shaving apparatus wherein water is continually provided to the shaving apparatus to continually clean the cutting edge and to moisten the surface to be shaved prior to and during actual shaving.

Therefore, in accordance with one aspect of the present invention there has been provided a shaving apparatus comprising a shaver which includes a head comprising means for attaching a shaving edge thereto and at least one orifice for dispersing water from the head in the proximity of the shaving edge; a handle comprising a water conduit which extends along the longitudinal axis of the handle, the handle being connected at one end thereof to the head; valve means, adapted for connection to a conventional water supply, for regulating the flow of water to the shaving apparatus, wherein the valve means provides a continuous flow of water; a flexible tubing connecting the shaver handle to the valve means; and means for providing a swivel connection of the flexible tubing to the shaver handle.

In a preferred embodiment, the shaver rotates through 360° in relation to the tubing. Advantageously the swivel means which provides for this rotation comprises a swivel guide inserted into the handle, a swivel connector fitted onto the swivel guide, and a water conduit and swivel retainer inserted through the swivel connector into the swivel guide.

In still another preferred embodiment, the swivel means includes multiple swivels. For example, if desired, a swivel can be provided at both ends of the tubing, i.e., connecting the tubing at one end to the handle and at the other end to the valve means.

In one embodiment, the shaving edge comprises a means for attaching the shaving edge directly to the head. For example, the shaving edge can comprise a slide coupling means which engages a slide provided to the head in the proximity of the at least one orifice. In a second embodiment, the shaving edge is part of a distinct structure which can be attached to the shaving apparatus in a manner such that, while the shaving edge is spaced from the head, it is positioned in proximity to the at least one orifice such that the shaving edge is still affected by the dispensed water.

In accordance with both the first and second embodiments described immediately above, the head portion preferably comprises a plurality of orifices for dispersing water. Especially in connection with the first embodiment, the plurality of orifices includes a first set of orifices extending laterally along the attaching means of the shaver head for dispersing water outwardly from the head and over the shaving edge, and a second set of orifices also extending laterally along the shaver head and positioned below the attaching means for dispersing water outwardly from the head portion and directly onto the surface to be shaved.

Furthermore, the present apparatus preferably utilizes a commercially available shaving blade as the shaving edge.

In accordance with yet another aspect of the present invention, there has been provided a method for latherless shaving, comprising the steps of supplying water to the above-described shaving apparatus, and directing the shaving apparatus in shaving engagement with the surface to be shaved.

Other objects, features and advantages of the present invention will become more apparent to those skilled in the art upon reviewing the detailed description of preferred embodiments which follows, when considered in light of the figures of drawing.

FIG. *2a* is a cross-sectional view of the swivel connector of the present shaving apparatus.

FIG. 3 is a side elevation view of one embodiment of the shaver of the present shaving apparatus.

Figure 4:
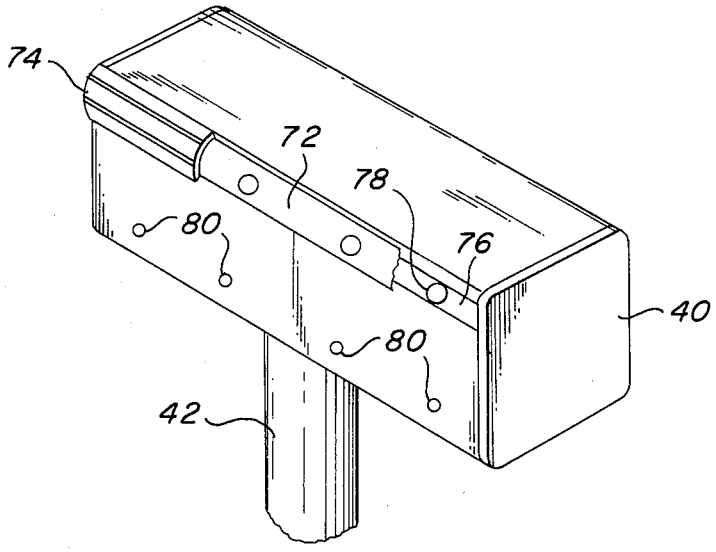

FIG. 4 is a front perspective view of a preferred shaver head of the present shaving apparatus according to the embodiment illustrated in FIG. 3.

FIG. 5 is a side elevation view of another embodiment of the present shaving apparatus.

FIG. *5a* is a top, plan view of the bottom attaching means illustrated in FIG. 5.

FIG. 6 is a front perspective view of the embodiment of the shaving apparatus illustrated in FIG. 5.

FIG. 7 is a schematic representation of the valve means in accordance with the present shaving apparatus.

DETAILED DESCRIPTION OF PREFERRED EMBODIMENTS

The shaving apparatus of the present invention will first be described by reference to the figures of drawing.

Figure 1:
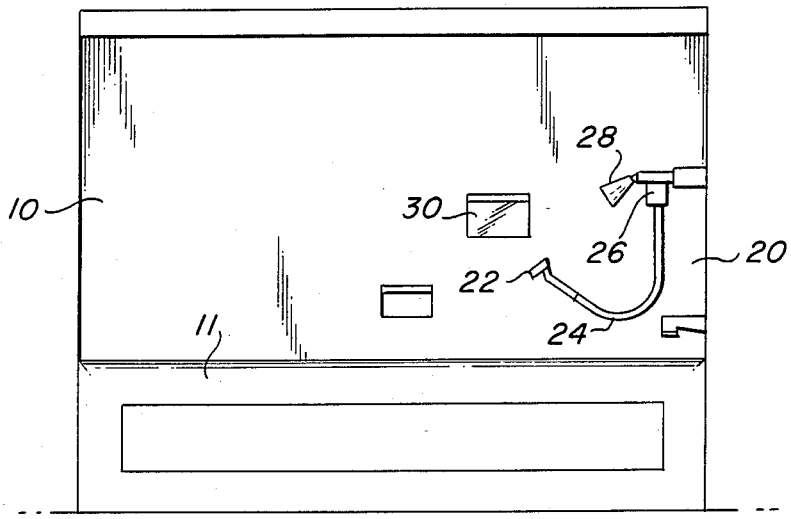
FIG. 1 schematically illustrates the shaving apparatus according to the present invention.

FIG. 1 schematically illustrates a shower facility 10 which may optionally be provided with a bathtub 11 or other similar bathing apparatus. The shaving apparatus according to the present invention is provided within the shower facility 10 and is generally referred to by reference numeral 20. The shaving apparatus 20 includes a shaver 22, a flexible tubing 24 and a valve means 26. Also illustrated in FIG. 1 is a water supply means 28, in this embodiment a showerhead. The shaving apparatus 20 may also include a reflective surface 30 which is attachable to the walls of the shower facility 10, or is otherwise adaptable for mounting in the vicinity in which the user will use the shaving apparatus.

Figure 2:
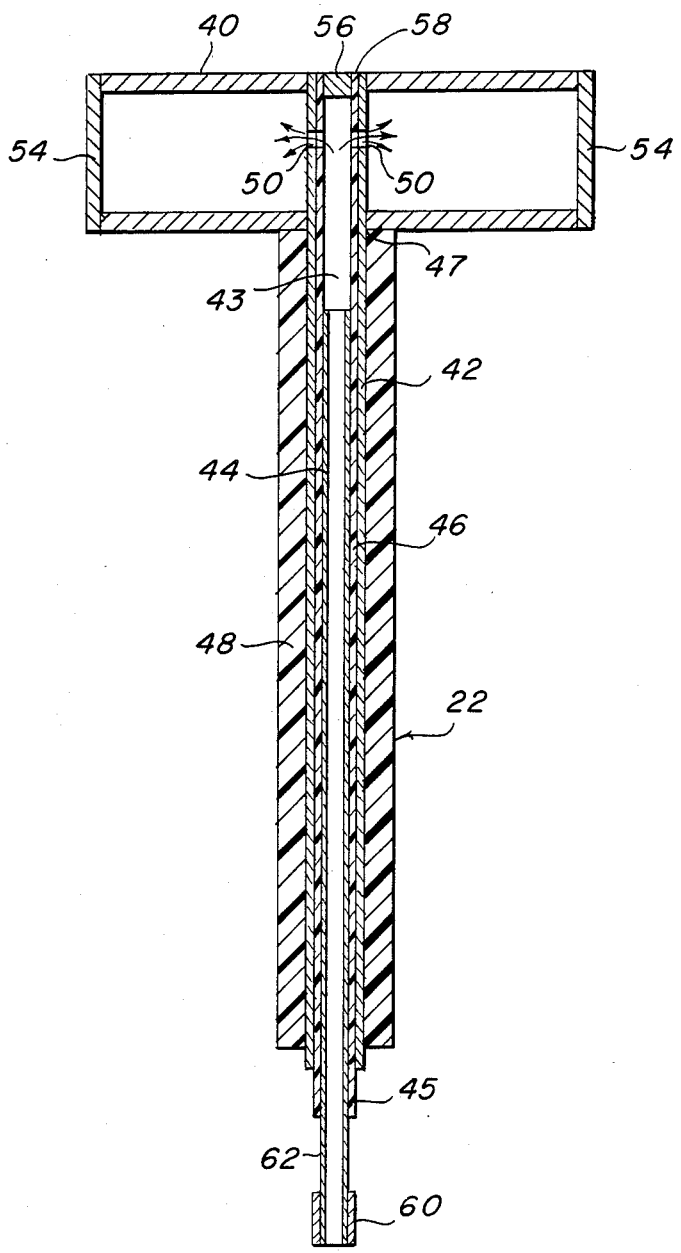
FIG. 2 is a front cross-sectional view of the shaver of the present shaving apparatus.

With reference now to FIG. 2, the shaver 22 comprises a head 40 and handle 42. The handle 42 is attached at one end to the head 40, preferably in the vicinity of the center of the laterally extending head. In the preferred embodiment illustrated in FIG. 2, the handle extends into and across the width of the head 40. The handle 42 has a longitudinally extending water passageway 43 which houses a water conduit 44. The water conduit 44 extends into the end of the shaver handle opposite the head to a position short of the head. As will be described in more detail in FIG. 3, the preferred termination point of the water conduit is a point at least equal to or slightly above a bend in the handle. The bend serves, as one of its functions, to lock the water conduit in the handle. Of course it will be readily apparent that the water conduit can extend further along the handle and even into the head 40.

The shaver further includes a novel swivel means 45. The swivel means 45 comprises a swivel guide 46 which is positioned in the water passageway 43 between the handle 42 and the water conduit 44. The swivel guide 46 extends along the entire length of the handle and may extend into, and possibly across the width of, the shaver head via an orifice 47 provided, preferably, in an area substantially in the center of the laterally extending head. Preferably, the swivel guide 46 and the handle 42 extend into the head 40 to the same position. Most preferably, the swivel guide and handle extend to the top of the head where they are joined to the head.

Additionally, the handle may be provided with a grip 48. The grip preferably extends from a point equal to or near the end of the handle 42 opposite the head 40 to a point flush with or substantially close to the head 40.

As depicted in the embodiment illustrated in FIG. 2, the handle 42 and the swivel guide 46 extend into the head 40 via the orifice 47 to a point substantially close to the top of the head. The handle and swivel guide are provided with at least one orifice 50 opening into either side of the head. The orifices 50 allow for the flow of the water provided to the shaver handle 42 and water passageway 43 by water conduit 44 to be distributed into the head.

Referring now to the head 40, in addition to the orifice 47, the head includes a bore 52 extending along the interior of the laterally extending head. The bore functions to receive the water passing from the water passageway 43 through the orifices 50. The head is provided at each end with end caps 54 to prevent the escape of the water from the head. Additionally, a plug 56 is inserted through an aperture 58 in the top of the head. The plug caps the handle and swivel guide to prevent the passage of water out of the top of the head.

While the above-described preferred embodiment represents one arrangement for the water conduit, swivel guide and handle, variations of the arrangement will be apparent to the skilled artisan. For example, the swivel guide and handle could extend only partially into the head.

The swivel means 45 referred to above includes further elements in addition to the swivel guide 46. As shown in FIG. 2, a swivel retainer 60 is provided in spaced relation from the end of the swivel guide 46 near the end of the water conduit 44. The gap, generally referred to as 62, between the swivel guide 46 and the swivel retainer 60, receives a swivel connector 64 illustrated in FIG. 2*a* and described below.

The swivel connector 64 includes, adjacent its inner diameter, a swivel bushing 66. The bushing 66 is dimensioned so that its inner diameter is at least slightly greater than the outer diameter of the water conduit. The inner diameter of the bushing should not, however, be larger than the outer diameter of the swivel guide 46 and swivel retainer 60, otherwise the swivel connector would not be held in place by these elements. The swivel connector 64 has a crimp joint 68 which engages the swivel bushing 66 along the interior of the swivel connector.

FIG. 3 illustrates the present shaver 22 in side elevation view. According to this embodiment, the head 40 of the shaver 22 includes attaching means 70, which, in a preferred embodiment, comprises a slide 72 for receiving the shaving edge 74. A spacer element 76 connects the slide 72 to the head 40. The shaving edge 74 includes a slide coupling means 77 which slideably receives the slide 72.

FIG. 3 also illustrates the advantageous bend in the handle 42. The handle is bent near the shaver head at an angle $\theta$ obtuse to the horizontal. The angle $\theta$ by which the handle is bent is selected to provide the user with the most preferred and comfortable position in which to use the shaver. This angle preferably is between about 115° and 130°, and most preferably, is about 122°. Furthermore, the bend in the handle serves the additional purpose of securing the water conduit 44 at its predetermined position in the handle as described above. The water conduit 44 is depicted in FIG. 3 to illustrate the relationship of the bend of the handle to the water conduit.

FIG. 4 illustrates the shaver head and orifice structure in more detail. As shown, a first set of orifices 78 is provided along the slide 72 and the spacer 76 of the attaching means 70. Additionally, a second set of orifices 80 is provided along the head 40 below the first set of orifices 78. The orifices 78, 80 are in communication with the inner bore 52, which in turn is in communication with the water passageway 43 via the orifices 50 as described above in greater detail by reference to FIG. 2. FIG. 4 also illustrates the shaving edge 74 in front view as it is attached to slide 72.

The size of orifices 78, 80 can vary; however, as illustrated in FIG. 4, the orifices 78 preferably have a larger diameter than the orifices 80. The maximum size of the orifices 78 is limited by the space between the razor blade(s) and housing of the shaving edge 74. Exemplary orifice sizes are about 3/32" for the orifices 78 and 1/32" for the orifices 80.

FIG. 5 illustrates another embodiment of the present shaving apparatus. As illustrated therein the shaver 22 can be essentially of the same structure as that described previously by reference to FIG. 2. The shaver 22 comprises a head 40 and handle 42. Additionally, the shaver is provided with the advantageous swivel means 45. The elements have been described in detail above with regard to FIGS. 2–4. As illustrated in FIG. 5, the head 40 is provided with orifices 96 which dispense water under and across the shaving edge 100 described in greater detail below.

In this second embodiment, the shaving head, instead of directly engaging the head 40, is part of a structure 103 which includes a head 102 and handle 104. The structure 103 is attached to the shaver 22 by means of clips 106, 108 or other similar attaching means. The bottom attaching clip 108 is shown in more detail in a top, plan view in FIG. 5*a*. The particular clip shape illustrated is not limitative. Any design which functions to attach the structure 103 to the shaver 22 can be utilized. The shaving edge 100 is positioned in relation to the orifices 96 such that the water dispensed from the orifices passes under and across the shaving edge 100 to both moisturize the shaving surface and to clean the shaving residue from the shaving edge.

The plurality of orifices 96 and the relation of the head 40 to the shaving edge 100 is also illustrated in more detail by the front perspective view of FIG. 6.

The valve means 26 is illustrated in more detail in FIG. 7. The valve means 26, in this preferred embodiment, is positioned just before the showerhead 28 so as to effectively connect the showerhead 28 with the pipe 84 through which water is supplied to the showerhead. The valve means 26 comprises a pipe extension 86 which is drilled and tapped to accept a flow control valve 88. The flexible tubing 24 is connected to the valve means 26 via a press fit provided by tightening the compression nut 90 over the compression ring 92 and onto the threaded arm 94 extending from the valve 88.

In operation, the showerhead or other similar water-supply means is adapted to receive the valve means in such a manner that the valve means can divert a portion of the water flow to the showerhead through the valve means to the flexible tubing. The valve means can be adjusted to control the flow of water through the valve by manually adjusting the control valve. The water passing into the flexible tubing is then transported through the tubing and into the shaver via the swivel means. In the embodiment presently illustrated, the flexible tubing is connected via a press fit with the swivel means. The water flows through the handle and into the head where it is channeled to and dispersed through the orifices.

The present shaver can be provided with a variety of orifice structures. The structure illustrated in FIGS. 3–4 provides two sets of orifices. The first set of orifices 78 is provided to the slide, and thus, are positioned directly behind the shaving edge. Such an arrangement results in the water being dispersed from the orifices so as to pass over, around and under the shaving edge, to wash away the shaving stubble from the blade and to continually moisturize the surface to be shaved. Thus, the first set of orifices provides for the continual self-cleaning of the shaving blade. The second set of orifices 80 is positioned along the head itself, below the slide and the first set of orifices. So positioned, the water which is dispersed through the second set of orifices directly contacts the surface to be shaved to moisten the surface prior to contact with the blade. Likewise, in the embodiment shown in FIGS. 5–6 a plurality of orifices are provided to the head in a manner such that the water dispensed is provided under and across the blade, as well as to the surface being shaved. The number and arrangement of these orifices, of course, can vary.

In another aspect of the present shaving apparatus, the novel swivel means of the present invention allows the shaver to rotate in relation to the flexible tubing without biasing the tubing. Thus in application, the tubing remains in an untwisted state while the user can rotate the shaver to any position. Thus, the shaver can be more easily positioned to conform to the curvatures of the surface to be shaved.

In another embodiment, multiple swivels are utilized. For example, a swivel could be positioned at each end of the flexible tubing. This arrangement further increases the maneuverability of the shaver.

Another characteristic of the present shaving apparatus which promotes the less cumbersome operation of the shaver is that the present valve means, and the position it assumes, relieves the water pressure on the tubing and shaver. Accordingly, the need for heavier, more durable materials is eliminated, and lightweight, low pressure material can be utilized.

The attaching means of the present shaver allows for the use of commercially available razor blades. According to the embodiment illustrated in FIGS. 3–4, a commercially available Gillette TRAC II razor blade would be useful since this blade has a structure which would allow it to be slid directly onto the slide attaching means. Similarly, in the embodiment illustrated in FIGS. 5–6, a commercially available Bic disposable razor would be useful. Obviously, the attaching means can be modified to be adaptable to the multiplicity of razor blades presently on the market. An advantage of being able to use commercially available razor blades, such as the Gillette TRAC II and the Bic disposable, is that these blades come provided with proven blade guards.

The shaving apparatus can also include a reflective, non-fogging surface, e.g., a mirror, which can be mounted so that the user can use the mirror during shaving. For example, the mirror can be provided with suction cups on its backside which allow for the mirror to be easily attached to the shower wall.

The elements comprising the present shaving apparatus can be made from a variety of possible materials depending on design criteria and user preference. The materials and dimensions listed below are not limitative in nature, but simply are provided to illustrate possible materials and dimensions which have proven to be advantageous for the present shaving apparatus.

Accordingly, the head, handle, spacer, slide, swivel connector and end caps can all be made from stainless steel. Additionally, a wide range of polymeric materials can also be utilized, should be even more lightweight structure be required, e.g., thermosetting resins, polystyrene, nylon, polyvinyl chloride or a polyolefin such as polypropylene.

The swivel guide, water conduit, swivel retainer, swivel bushing, pipe extension and plug can all be prepared from brass or other similar corrosion resistant material. These too can be made of plastic.

The water supply tubing can be made from a variety of polymeric materials. In a preferred embodiment, the tubing comprises polyethylene. The grip, which is provided on the handle, is preferably a clear plastic, e.g., TYGON, tubing and extends along the length of the handle to a point substantially flush with the head. The attaching clips used with the second embodiment can comprise any non-rusting spring material.

The shaving apparatus is easy to assemble. A head and handle are selected and formed according to the preselected dimensions. These elements are then drilled to form the inner bore and inner passageway of the head and handle respectively. A further hole is drilled through the center of the head to receive the handle. Orifices are then drilled into the face of the head. Also, the handle and swivel guide are provided with orifices which allow for the passage of water from the water passageway into the head. The handle and swivel guide are then inserted into the head. A plug is then inserted into the top of the head where the head was drilled to receive the handle. In the case of the use of stainless steel and brass, as noted above, the handle, swivel guide, head and plug are soldered using an alloy of 96.5% tin and 3.5% silver which provides a strong, non-toxic joint. The soldered part is thereafter rinsed. The combination of brass and steel in this joint add greatly to the strength of the unit. The head and handle are further soldered at the aperture of the base of the head where the handle enters the head. End caps are attached to the head, in the case of stainless steel, also by soldering.

The various stainless steel elements are, after being joined, ground to a final finish. Thereafter, the swivel connector is fitted onto the swivel guide, and the water conduit and swivel retainer are inserted through the swivel connector into the swivel guide. The completed handle assembly is bent to establish the proper blade angle. The unit may then be given a final surface finishing, and the grip is slid into place on the handle.

In the embodiment in which the head is provided with a slide, the spacer and slide are soldered to the head and the orifices are thereafter drilled through the slide and spacer to the internal bore. In the embodiment in which the shaver is provided with a separate, independent structure, the structure is positioned with respect to the head and orifice such that the necessary water dispersal is achieved. The structure is then attached to the shaver by means of the attaching means. Preferably, the structure and the shaver are secured at the handle end opposite the head and at a position just below the shaver head.

The dimensions of the shaving apparatus are not limitative, but will, instead, depend on user preference and design considerations. For example, the head can range in length from about 1½" to about 1⅝", preferably being approximately 1 9/16". Preferably, the shaver is approximately ½" high and ½" wide.

The handle is preferably tubular in structure, having an outside diameter of between about 0.185" and about 0.19", preferably about 3/16", with an inside diameter of from about 0.155" to about 0.16", and preferably of about 5/32". The length of the handle can range from about 3" to about 6", and in a preferred embodiment is about 4" long.

The shaving apparatus according to the present invention is adaptable for use in a variety of locations which have a water supply means which can be adapted to facilitate the valve means so as to supply water to the shaving apparatus. Preferably, the shaving apparatus can be used in shower or shower/bath facilities since the shower head and associated piping can be easily modified to receive the head.

The present shaving apparatus can also be used in shower facilities which are provided with "water-saver" means. The reduced water flow through the shower head does not hinder the operation of the valve means which will continue to supply the requisite water flow to the shaver.

The present shaving apparatus provides many useful advantages not heretofore enjoyed. For instance, the swivel means allows the shaver to be positioned in any manner without having to worry about winding or otherwise twisting the flexible tubing. This allows the user more freedom of movement with the shaver and leads to a closer, more effective and manageable shave.

Secondly, the orifice structure of the present shaver leads to the advantageous result of the shaver moistening, shaving and self-cleaning without the user having to intermittently stop shaving to clean the blade surface. Furthermore, the resulting shave is very hygenic. Additionally, the user need not use any shaving cream or soap to pre-moisturize the body surface to be shaved. As a further benefit of the shaving apparatus, the shaving blades which are used do not require replacement as often as those used in the typical lather shave.

The provision of the valve means of the present invention has the advantage that it can control the flow of water while still allowing the water to be provided through the shaver in a continuous manner. The prior shaving apparatuses known to the inventors, which have used a water feed concept, have not provided such continual flow, and have subjected their on/off valves to the continual back pressure of the public water supply.

What is claimed is:

1. A shaving apparatus, including:

a shaver which comprises:

a head comprising means for attaching a shaving edge thereto, and at least one orifice for dispersing water from said head in the proximity of said shaving edge, and a handle comprising a water conduit which extends along the longitudinal axis of said handle, said handle being connected at one end thereof to said head;

valve means, adapted for connection to a conventional water-supply, for regulating the flow of water through the shaving apparatus, wherein said valve means provides a continuous flow of water;

a flexible tubing connecting said shaver handle to said valve means; and means for providing a swivel connection of said flexible tubing to said shaver handle.

2. A shaving apparatus as claimed in claim 1, wherein said shaver rotates through 360° in relation to said tubing.

3. A shaving apparatus as claimed in claim 1, wherein said swivel means comprises a swivel guide inserted into said handle, a swivel connector fitted onto said swivel guide, and a water conduit and swivel retainer inserted through said swivel connector into said swivel guide.

4. A shaving apparatus as claimed in claim 1, wherein said head comprises a plurality of said orifices for dispersing water.

5. A shaving apparatus as claimed in claim 1, wherein said shaving edge attaching means is provided adjacent to the face of said head comprising said at least one orifice.

6. A shaving apparatus as claimed in claim 5, wherein said attaching means comprises a slide for receiving a shaving edge having a slide coupling means.

7. A shaving apparatus as claimed in claim 5, wherein said shaving edge comprises a commercially available shaving blade.

8. A shaving apparatus as claimed in claim 5, comprising a first set of orifices extending laterally along said attaching means of said head for dispersing water outwardly from said head and over said shaving edge, and a second set of orifices extending laterally along said shaver head and positioned below said attaching means for dispersing water outwardly from said shaver head and directly onto the surface to be shaved.

9. A shaving apparatus as claimed in claim 8, wherein each of said first and second set of orifices comprises at least 4 orifices.

10. A shaving apparatus as claimed in claim 1, wherein said head and handle include means for attaching a separate, disposable razor thereto.

11. A shaving apparatus as claimed in claim 10, wherein said disposable razor comprises a head and handle structure, said handle of said shaving edge structure being attached to the handle of said shaving apparatus and said head of said shaving edge structure being positioned in relation to said at least one orifice of said head to be effected by said dispensed water.

12. A shaving apparatus as claimed in claim 10, wherein said head comprises a plurality of orifices extending laterally along said head.

13. A shaving apparatus as claimed in claim 1, wherein said water supply means comprises a showerhead.

14. A method for latherless shaving, comprising the steps of: supplying water to the shaving apparatus of claim 1; and directing the shaving apparatus in shaving engagement with the surface to be shaved.

15. A shaving apparatus, including:

a shaver which comprises:

a head comprising a slide for receiving a shaving edge having a side coupling means, a first set of orifices extending laterally along said slide for dispensing water outwardly from said head and over said shaving edge, and a second set of orifices extending laterally along said shaver head below said first set of orifices for dispersing water outwardly from said shaver head and directly onto the surface to be shaved, and a handle comprising a water conduct which extends longitudinally along said handle, said handle being connected at one end thereof to said head;

valve means, separate from said shaver and adapted for connection to a conventional water supply, for regulating the flow of water through the shaving apparatus, wherein said valve means provides a continuous flow of water;

a flexible tubing connecting said shaver handle to said value means; and means for providing a swivel connection between said flexible tubing and said shaver handle, said swivel connection means comprising a swivel guide inserted into said handle, a swivel connector fitted onto said swivel guide, and a water conduit and a swivel retainer inserted through said swivel connector into said swivel guide.

16. A shaving apparatus, including:

a shaver which comprises a head comprising a plurality of orifices extending laterally along said head;

a handle comprising a water conduit which extends along the longitudinal axis of said handle, said handle being connected at one end thereof to said head;

means for attaching a separate common disposable razor to said head and handle, said disposable razor comprising a head and handle structure, wherein said handle of said disposable razor is attached to said handle of the shaving apparatus and said head of said disposable razor is positioned in relation to said plurality of orifices to be effected by said dispensed water;

valve means, separate from said shaver and adapted for connection to a conventional water-supply, for regulating the flow of water through the shaving apparatus, wherein said valve means provides a continuous flow of water;

a flexible tubing connecting said shaver handle to said valve means; and means for providing a swivel connection between said flexible tubing and said shaver handle, said swivel connection means comprising a swivel guide inserted into said handle, a swivel connector fitted onto said swivel guide, and a water conduit and a swivel retainer inserted through said swivel connector into said swivel guide.

* * * * *